United States Patent [19]

Kohyama et al.

[11] Patent Number: 4,836,135

[45] Date of Patent: Jun. 6, 1989

[54] DEVELOPING APPARATUS HAVING ONE-COMPONENT DEVELOPING AGENT

[75] Inventors: Mitsuaki Kohyama, Tokyo; Naruhito Yoshida, Yokohama; Osamu Takagi, Tokyo, all of Japan

[73] Assignee: Kabushiki Kaisha Toshiba, Kawasaki, Japan

[21] Appl. No.: 82,507

[22] Filed: Aug. 7, 1987

[30] Foreign Application Priority Data

Aug. 11, 1986 [JP] Japan ..... 61-188315

[51] Int. Cl.[4] ..... G03G 15/08

[52] U.S. Cl. ..... 118/653; 355/259; 355/261

[58] Field of Search ..... 118/653, 612; 355/30 D

[56] References Cited

U.S. PATENT DOCUMENTS

| | | | |
|---|---|---|---|
| 3,232,190 | 2/1966 | Willmott | 95/1.7 |
| 3,866,574 | 2/1975 | Hardennrook et al. | 118/637 |
| 3,893,418 | 7/1975 | Liebman et al. | 118/637 |
| 3,894,510 | 7/1975 | Eto | 118/308 |
| 4,181,422 | 1/1980 | Forgo et al. | 355/3 DD |
| 4,481,903 | 11/1984 | Haberhauer et al. | 118/653 |
| 4,696,255 | 9/1987 | Yano et al. | 118/653 |

FOREIGN PATENT DOCUMENTS

| | | | |
|---|---|---|---|
| 59-31979 | 2/1984 | Japan . | |
| 60-33578 | 2/1985 | Japan . | |
| 60-51847 | 3/1985 | Japan . | |
| 61-156167 | 7/1986 | Japan . | |
| 61-159675 | 7/1986 | Japan . | |
| 0170766 | 8/1986 | Japan | 355/3 DD |
| 1458766 | 12/1976 | United Kingdom . | |

*Primary Examiner*—Shrive Beck
*Assistant Examiner*—Alain Bashore
*Attorney, Agent, or Firm*—Foley & Lardner, Schwartz, Jeffery, Schwaab, Mack, Blumenthal & Evans

[57] ABSTRACT

In a developing apparatus, a toner stored in a vessel is supplied to a developing roller by a toner supply roller. The toner supply roller is disposed between the vessel and roller and is partitioned from vessel by a partition plate. A elastic member of the toner supply roller is brought into contact with the inner surface of the partition plate, thereby charging the toner transferred by the elastic member by friction.

6 Claims, 1 Drawing Sheet

DEVELOPING APPARATUS HAVING ONE-COMPONENT DEVELOPING AGENT

BACKGROUND OF THE INVENTION

The present invention relates to a developing apparatus, applied to an electrophotographic device such as an electrophotographic copying machine, for developing an electrostatic latent image by a one-component developing agent.

Conventionally, developing techniques such as a cascade technique and a magnet brush technique are mainly used in electrophotographic devices such as an electrophotographic copying machine, a facsimile device, and a printer. However, since color recording is popular in recent years, a technique of developing in a noncontact state an image on a photosensitive body capable of superposing and developing an unfixed image has been studied. A basic arrangement of such a noncontact type developing technique is disclosed in U.S. Pat. Nos. 3,232,190, 3,866,574, and 3,893,418 or in G.B. Pat. No. 1,458,766. In these disclosed apparatuses, a developing roller is arranged close to a photosensitive drum at a small gap of about 5 to 500 μm, and a thin uniform toner layer is formed on a cylindrical surface of the developing roller. A DC or AC voltage is applied between the developing roller and the photosensitive drum to produce a DC or AC electric field in the gap therebetween. As a result, toner particles fly and become adhered to an electrostatic latent image on the photosensitive drum where the electric field intensity is high. In a non-image portion, flight of toner particles is restricted, and in the AC electric field, toner particles return to the developing roller. Thus, toner is selectively adhered on the photosensitive drum to develop an electrostatic latent image. On the other hand, in U.S. Pat. No. 3,893,418, gradation reproducibility is selected by switching a frequency utilizing the fact that gradation of a developed image varies in accordance with a frequency of an applied AC voltage.

A most important point in these techniques is to uniformly form a toner layer on the developing roller and to uniformly charge the toner. In consideration of this situation, the present inventors have proposed improved techniques of forming a toner layer in Japanese Patent Disclosure (Kokai) No. 59-31979, or Japanese patent application Nos. 58-143340 and 58-161241. In these techniques, since an elastic blade is abutted against a developing roller to form a toner layer, a toner layer can be uniformly formed on a developing roller with a very small and simple arrangement.

When a negative electrostatic latent image is to be developed or a positive electrostatic latent image is to be reversely developed, a toner which is charged to have a positive polarity is used. In this case, in order to improve a frictional charging property with respect to a toner, a charge control agent or a resin is added to a toner. However, as for a positively charged toner, no such charge control agent or resin having good properties is present, and a charge amount of a toner layer formed on a developing roller is unstable. As a result, fogging of an image tends to occur, and a layer formation characteristic is degraded under humid conditions. Therefore, when a toner having a positive polarity is used, an electrophotographic characteristic is poor as compared with a case wherein a toner having a negative polarity is used. Although such a situation does not change in a two-component developing method, the above drawbacks are typical in a one-component developing method, so that a strong demand has arisen for a drastic countermeasure.

SUMMARY OF THE INVENTION

It is, therefore, an object of the present invention to provide a developing apparatus capable of sufficiently charging a toner and reproducing a highquality image.

According to the present invention, there is provided a developing apparatus comprising:

- a rotatable developing roller having a surface on which a toner is adhered, for transferring the toner along with rotation thereof;
- a toner storage vessel for storing a toner to be supplied to the developing roller;
- a rotatable toner supply roller, arranged between the toner storage vessel and the developing roller, for supplying the toner from the toner storage vessel to the developing roller along with rotation thereof, the toner supply roller having an elastic member brought into contact with the developing roller to transfer the toner thereto; and
- regulating means, in which the toner supply roller is housed, for regulating a toner supply path, the regulating means including a partition plate for partitioning the toner storage vessel from the toner supply roller to define a supply port through which the toner is supplied from the toner storage vessel to the toner supply roller, the partition plate having an inner surface with which the elastic member of the toner supply roller is brought into contact throughout a predetermined range along with rotation of the toner supply roller, and the elastic member of the toner supply roller being brought into contact with the inner surface of the partition plate, thereby charging the toner transferred by the elastic member by friction.

DETAILED DESCRIPTION OF THE PREFERRED EMBODIMENTS

Figure 1:
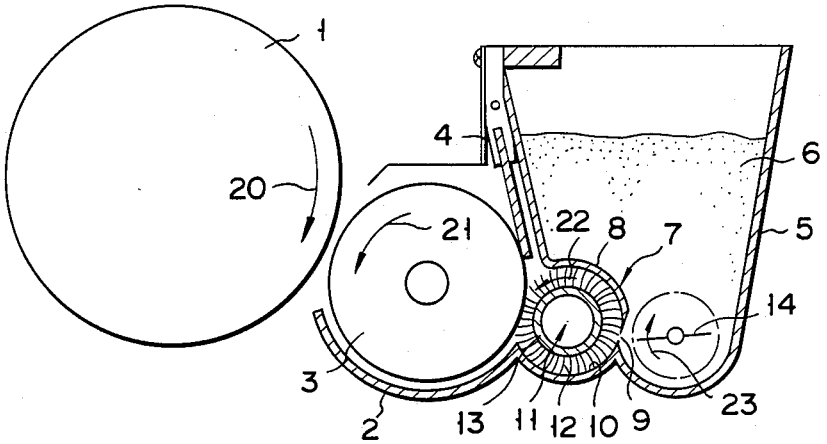
FIG. 1 is a schematic view of a developing apparatus according to an embodiment of the present invention.

A first embodiment in which the present invention is applied to an electrophotographic photosensitive body will be described below with reference to FIG. 1. In FIG. 1, photosensitive drum 1 is arranged to be rotatable in a direction indicated by arrow 20. Conductive developing roller 3 having an axis parallel to that of drum 1 is arranged to roll on the surface of drum 1 or to be separated therefrom by a predetermined interval. Roller 3 rotates in a direction indicated by arrow 21 and is surrounded by housing 2. The distal end of developing agent regulating member 4 which is a plate-like elastic body made of phosphor bronze, stainless steel, urethane rubber, or the like is brought into contact with roller 3. Regulating member 4 regulates a toner amount on the surface of roller 3 to form a toner layer having a thickness of 20 to 50 μm on the surface, and the toner is charged to have a predetermined polarity by friction produced between the surface of roller 3 and regulating member 4. An amount and a polarity of this frictional charge are determined by the material of the toner, the materials of regulating material 4 and roller 3, and strength of the friction force. Therefore, the materials of these members may be selected in accordance with a desired charge amount and polarity as in a conventional manner. For example, the toner consists of a styrene-acrylic copolymer resin and carbon for coloring the resin, regulating member 4 consists of a thin metal piece such as a thin stainless steel piece normally used for a leaf spring, and roller 3 consists of a metal cylinder such as an aluminum or Fe cylinder, the surface of which is finished to be a coarse surface.

Storage vessel 5 is arranged at a side opposite to drum 1 and close to roller 3, and toner 6 of one component system having an average grain size of 5 to 20 μm and can be frictionally charged is stored in vessel 5. Developing agent supply roller 11 is disposed between vessel 5 and roller 3 to be partitioned from vessel 5 by partition member 7. Roller 11 has cylindrical base portion 13 and brush-like elastic portion 12 extending from the surface of base portion 13. Roller 11 similarly having an axis parallel to that of roller 3 can rotate in the same direction indicated by arrow 22 as that of roller 3 and is arranged in chamber 10 surrounded by partition member 7 and housing 2. Partition member 7 is curved at substantially the same radius of curvature as that of the outer peripheral edge of elastic portion 12. Partition member 7 has friction portion 8 with which the peripheral edge of elastic portion 12 is brought into contact for a length of about 1 mm or less, and slitlike opening 9 which causes chamber 10 to communicate with vessel 5 and is defined by partition member 7 and housing 2.

Vane-type agitator 14 is arranged at the bottom of vessel 5 so that its rotation axis extends along a rotation axis of roller 11, and is rotated in a direction opposite to that of roller 11, i.e., a direction indicated by arrow 23. By rotation of agitator 14, a toner can be smoothly transferred into chamber 10 through opening 9 at the lower portion of vessel 5, thereby preventing formation of a cavity at the lower portion of vessel 5.

Elastic portion 12 of roller 11 consists of a fiber such as polytetrafluoroethylene (trade name "Teflon"), polymethyl methacrylate (PMM), or viscose rayon, and more preferably a Teflon fiber, and is formed to extend from base portion 13. When the peripheral edge of brush-like elastic portion 12 constituted by the above fibers slidably contacts friction portion 8 of partition member 7 for a length of about 1 mm or less, a toner to be transferred to elastic portion 12 is rubbed against friction portion 8 and is sufficiently charged to have a positive polarity. In order to charge a toner to have a negative polarity, a fiber such as polyethylene terephthalate or polyamide may be used for elastic portion 12.

Note that elastic portion 12 of roller 11 is not limited to an arrangement of this embodiment in which a fiber extends from base portion 13. For example, elastic portion 12 may be arranged by coating the surface of base portion 13 with a sponge-like polyurethane or styrene-butadiene rubber. When this urethane or styrene-butadiene rubber is used, a toner is charged to have a positive polarity. In order to charge a toner to have a negative polarity, a sponge-like elastic portion may be formed by a material such as polypropylene or polyamide. In either case, these materials are merely examples. Therefore, a material may be selected to charge a toner to have a desired polarity after a combination with a toner is confirmed by experiments.

Friction portion 8 of partition member 7 may be formed of any of metals such as stainless steel, phosphor bronze, brass, and aluminum; these metals which are nickel plated or subjected to an anodized aluminum treatment; polyester; or plastics such as Teflon. When the inner surface of friction portion 8 on which elastic portion 12 slidably contacts is made coarse to increase a friction area, an amount of charge can be increased. In addition, a sponge or a brush may be adhered on the inner surface of partition member 7, and a toner may be charged by friction produced between the sponge or brush portion and elastic portion 12. In either case, a material of friction portion 8 may be selected in consideration of a frictional charging property with respect to a toner.

An operation of the developing apparatus having the above arrangement will be described below. An electro-static latent image is formed on drum 1 with −400 to −800 V, and drum 1 is rotated in a direction indicated by arrow 20 at a constant speed. A DC bias power source voltage of −0 to −200 V or an AC voltage (with a frequency of 200 Hz or more) of 800 to 1,600 V which is shifted to the negative side by 0 to 200 V is applied between drum 1 and roller 3 by a proper bias power source (not shown). When roller 3 is rotated at a speed equal to that of drum 1, roller 3 may be substantially brought into contact with drum 1 and roll thereon. However, in order to give an image gradation, roller 3 is kept in a noncontact state with respect to drum 1. When an AC bias voltage is to be applied between drum 1 and roller 3, a rotational speed of roller 3 is preferably increased larger than that of drum 1 to increase image density.

A toner in vessel 5 is agitated by agitator 14 and supplied to roller 11 through opening 9 of partition member 7. The toner is transferred to roller 3 by elastic portion 12 of roller 11 which rotates in a direction indicated by arrow 22. During this transfer, the toner is charged to have a predetermined polarity by friction produced between elastic portion 12 and friction portion 8 of partition member 7. Thus, the toner is charged to have a predetermined polarity by roller 11, transferred to roller 3 by rotation of roller 11, and then supplied to roller 3 at a substantially constant supply amount. The toner is adhered on roller 3 by mechanical and electrostatic forces and coated on its surface.

An excess amount of the toner on the surface of roller 3 is removed by regulating member 4, the distal end of which contacts roller 3, thereby forming a toner layer having a uniform thickness of 20 to 50 μm. In addition, the toner is further charged to have a predetermined polarity by friction of regulating member 4. Then, the toner which is sequentially transferred on the surface of roller 3 by rotation of roller 3 is brought into contact with drum 1 and transferred thereon by the electric field between roller 3 and drum 1, or flies to drum 1 and is transferred thereon, thereby developing an electrostatic latent image on the surface of drum 1.

In this embodiment, since roller 11 is interposed between vessel 5 and roller 3 and the toner is supplied from vessel 5 to roller 3 by rotation thereof, an irregularly large amount of toner is not adhered on roller 3. In addition, the toner is charged by not only friction with respect to regulating member 4 but also friction produced between elastic portion 12 and friction portion 8. Therefore, a sufficiently charged toner layer with a uniform thickness is formed on roller 3. For this reason, a stable image without fogging can be obtained. Furthermore, since the toner can be charged to have a predetermined polarity by arbitrarily selecting the materials or shapes of elastic portion 12 and friction portion 8, the toner is easily charged to have a positive polarity. This has been difficult in a conventional method in which image quality is improved by improving the characteristics of the toner.

Figure 2:
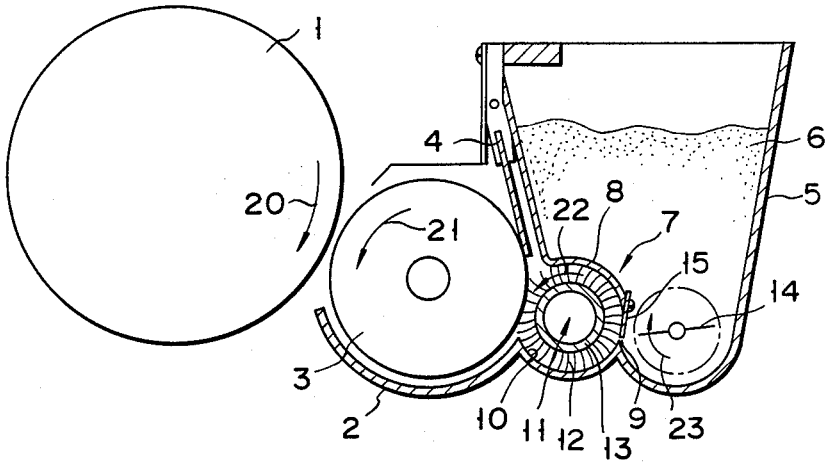
FIG. 2 is a schematic view of a developing apparatus according to another embodiment of the present invention.

A second embodiment of the present invention will be described below with reference to FIG. 2. In FIG. 2, the same parts as in FIG. 1 are denoted by the same reference numerals and a detailed description thereof will be omitted. The second embodiment differs from the first embodiment in that regulating piece 15 is mounted on partition member 7 so that the distal end thereof extends into opening 9. That is, regulating piece 15 slidably contacts the peripheral edge of elastic portion 12 of developing agent supply roller 11, thereby regulating a toner amount supplied to elastic portion 12 through opening 9. Regulating piece 15 may be formed of the same type of material as that of regulating member 4. By regulating piece 15, a supply amount of the developing agent can be adjusted more easily. In addition, when a sponge-like, not brush-like, relatively smooth elastic portion 12 is used, a toner is effectively precharged by regulating piece 15, thereby further improving image quality.

Note that the present invention is not limited to the above embodiments but can be variously modified. In addition, although friction portion 8 of partition member 7 may be formed to cover about $\frac{1}{3}$ of the peripheral edge of roller 11, a length of this portion where elastic portion 12 and friction portion 8 slidably contact with each other may be determined in accordance with a transfer amount or a charge amount of the toner. Furthermore, opening 9 of partition member 7 is preferably as narrow as possible. This is because a uniform toner layer can be formed on a developing roller when an uncharged toner in storage vessel 5 is supplied to roller 11 in a smaller amount.

As described above, according to the present invention, a toner is charged by friction produced between the elastic portion and the friction portion and then supplied to the developing roller. Therefore, a predetermined charged polarity of the toner is not limited to positive or negative, so that a toner layer can be uniformly formed on the developing roller. For this reason, an image of good quality without fogging can be obtained.

What is claimed is:

1. A developing apparatus comprising:

storing means for storing a one-component toner;

a rotatable developing roller having a surface on which a toner layer of the one-component toner is formed, for transferring the toner along with rotation thereof;

rotatable photosensitive drum means facing said developing roller with a gap therebetween, an electrical field being formed between said developing roller and said photosensitive drum means and an electrostatic latent image formed on said photosensitive drum means being developed by the toner which is caused to fly through the gap by force of the electrical field formed between said rotatable developing roller and said photosensitive drum means;

charging and transferring means, disposed between said developing roller and said storing means, for transferring the toner from said storing means to said roller and charging the transferred toner, said charging and transferring means having an elastic brush member and a partition plate, the elastic brush member being rotated and brought into contact with said developing roller and the partition plate, thereby transferring and charging the toner; and additional charging means for additionally charging the toner on said developing roller, said additional charging means having a plate with a distal end contacting the toner layer on said developing roller, the plate regulating the thickness of the toner layer and charging the toner.

2. A developing apparatus according to claim 1, wherein the partition plate serves to partition off said storing means from said charging and transferring means, thereby defining a toner supply port through which the toner is supplied from said storing means.

3. An apparatus according to claim 1, further comprising:

agitating means, disposed in said storing means, for agitating the toner therein.

4. An apparatus according to claim 1, wherein said rotatable photosensitive drum means is provided at a side opposite to said charging and transferring means to oppose said developing roller, an electrostatic latent image formed thereon being developed by the toner transferred by said developing roller.

5. A developing device for applying a one—component developer to a latent image on an image bearing member, comprising:

movable means, facing the image bearing member with a gap therebetween, for carrying the developer thereon, an electrical field being formed in the gap between the movable means and the image bearing member and an electrostatic latent image formed on the image bearing member being developed by the developer which is caused to fly through the gap by force of the electrical field;

storing means for storing the one-component developer therein;

supplying means for supplying the developer from the storing means to said movable means and charging the developer, said supplying means having an elastic brush portion for carrying the developer thereon and a partitioning member for defining a supply path in which the developer is to be supplied, the elastic brush portion being brought into contact with the movable means and the partitioning member to charge the developer; and charging means for charging the developer and regulating the thickness of the developer, said charging means having a portion contacting the movable means for restricting the passage of the developer and frictionally charging the developer.

6. The device of claim 5, further comprising:

agitating means disposed in said storing means for agitating the developer therein.

* * * * *